United States Patent [19]

Tone

[11] Patent Number: 4,854,515

[45] Date of Patent: Aug. 8, 1989

[54] WINDING CONTROLLING METHOD FOR AN AUTOMATIC WINDER

[75] Inventor: Shoichi Tone, Kyoto, Japan

[73] Assignee: Murata Kikai Kabushiki Kaisha, Kyoto, Japan

[21] Appl. No.: 158,309

[22] Filed: Feb. 22, 1988

[30] Foreign Application Priority Data

Feb. 26, 1987 [JP] Japan ..... 62-43810

[51] Int. Cl.[4] ..... B65H 54/02; B65H 63/00

[52] U.S. Cl. ..... 242/36; 242/18 R; 242/35.6 R

[58] Field of Search ..... 242/36, 37 R, 35.6 R, 242/18 R, 49; 340/679, 680; 377/15, 16, 37

[56] References Cited

U.S. PATENT DOCUMENTS

| | | | |
|---|---|---|---|
| 3,648,026 | 3/1972 | Abe et al. | 242/36 X |
| 3,648,027 | 3/1972 | Ganong, Jr. et al. | 242/36 X |
| 4,513,921 | 4/1985 | Imoda et al. | 242/36 |
| 4,666,096 | 5/1987 | Heel et al. | 242/36 |

*Primary Examiner*—Stanley N. Gilreath

*Attorney, Agent, or Firm*—Spensley Horn Jubas & Lubitz

[57] ABSTRACT

A winding controlling method for an automatic winder whereby the upper limit value for the yarn cut frequency per one spinning bobbin is set as an upper limit value for the yarn cut frequency while the number of successive spinning bobbins for which no yarn cutting occurs is set as a lower limit value for the yarn cut frequency, and winding operation of a winding unit is stopped at a point of time when either the upper limit value or the lower limit value for the yarn cut frequency is detected on the winding unit during winding.

20 Claims, 4 Drawing Sheets

| | CONDITION UPON WINDING STOPPING | YARN BREAKAGE | BOBBIN | YARN DEFECT | DETERMINATION |
|---|---|---|---|---|---|
| I |  | YARN BREAKAGE | HALF WOUND | PRESENT (BREAKAGE BY DEFECT) | SPINNING BOBBIN UNUSUAL (I - A) |
| | | | | NONE (BREAKAGE IN VAIN) | SLUB CATCHER UNUSUAL (I - B) |
| II |  | YARN CONTINUED | FULLY WOUND | | SLUB CATCHER UNUSUAL (II - A) |

WINDING CONTROLLING METHOD FOR AN AUTOMATIC WINDER

FIELD OF THE INVENTION

This invention relates to a winding controlling method for an automatic winder.

RELATED ART STATEMENT

Yarn produced on a spinning frame, particularly on a ring spinning frame, is normally wound onto a bobbin and transported and supplied as a so-called spinning bobbin after spinning to a rewinding step. Due to mechanical restrictions of a ring spinning frame, spinning bobbins have a relatively small amount of yarn of up to several hundreds grams at the most. Accordingly, they are rewound into packages wherein the amount of yarn and the profile are suitable for use at a subsequent step, that is, for use on a weaving machine or a knitting machine.

In an automatic winder which is applied for such a rewinding step, if there is a defect of yarn during winding such as a slub or a reduced thickness portion, following steps are commonly taken that the slub or the like is detected by a slub catcher provided on the winder, and then the yarn is cut positively and the yarn defect is removed, whereafter the yarn is knotted or spliced and then rewinding of the yarn is resumed.

In this instance, if there are many defects in a spinning bobbin, naturally the yarn cut frequency is great, and accordingly it cannot be avoided to increase the yarn joining frequency.

In particular, where a package on which a fixed amount of yarn is wound up has a number of joints produced by knotting, such joints may be caught by an eye of a needle or the like at a next step of a knitting machine or a weaving machine to cause break of the yarn so that yarn joining must be conducted frequently, or even if break of the yarn does not occur, an operation to force a knot projected on a surface of a woven fabric to the rear surface side of the fabric is required, which is very troublesome.

Meanwhile, a relatively high yarn joining frequency during rewinding implies that the quality of the yarn of the wound up package is low, that is, it can be considered that the yarn naturally has a large number of such yarn defects that may not be detected because it has a large number of yarn defects which have been detected by a slub catcher.

To the contrary, there also exist such cases wherein the yarn joining frequency is very low. In particular, where the yarn joining frequency is much lower than a statistically determined average value of frequencies of joining of yarn which occurs when a fixed amount of yarn is wound up, it can be considered, rather than that the quality of the yarn is high, that the sensitivity of the slub catcher is deteriorated so that it passes over yarn defects which are to be essentially detected.

Accordingly, also in such a case, a package having yarn wound up thereon involves such yarn defects that are to be essentially removed and is likewise an unacceptable package which will cause yarn breaks frequently at a next step.

It is to be noted that, also in the case wherein there is such a too high yarn joining frequency as described above, there may be a question in setting of the sensitivity of the slub catcher in addition to the question of the quality of the yarn. In any case, unacceptable packages are produced.

If such unacceptable packages are transported during acceptable packages, it is almost impossible for an operator to distinguish them by his eyesight at a knitting or weaving step.

A device which resolves the problems described above is disclosed in Japanese Patent Laid-Open No. 60-56775.

However, since the device mentioned just above relates to management after yarn has been wound up to a package, unacceptable yarn may be wound by a large amount, which will deteriorate the rate of operation and yield a loss of a large amount of yarn.

Furthermore, with the device, it cannot be found whether the cause of production of an unacceptable package resides on the spinning bobbin side, that is, on the yarn supply side or on the slub catcher side, that is, on the yarn defect detecting device side, and management after the fact to select packages produced is bewildering.

OBJECT AND SUMMARY OF THE INVENTION

It is an object of the present invention to propose a winding controlling method by which a disabled slub catcher is removed at an early stage and defective yarn spinning bobbins are detected and removed.

The upper limit value for the yarn cut frequency per one spinning bobbin is set as an upper limit value for the yarn cut frequency while the number of successive spinning bobbins for which no yarn cutting occurs is set as a lower limit value for the yarn cut frequency, and winding operation of a winding unit is stopped at a point of time when either the upper limit value or the lower limit value for the yarn cut frequency is detected on the winding unit during winding.

DETAILED DESCRIPTION OF EMBODIMENTS

Now, an embodiment of the present invention will be described with reference to the drawings.

Figure 1:
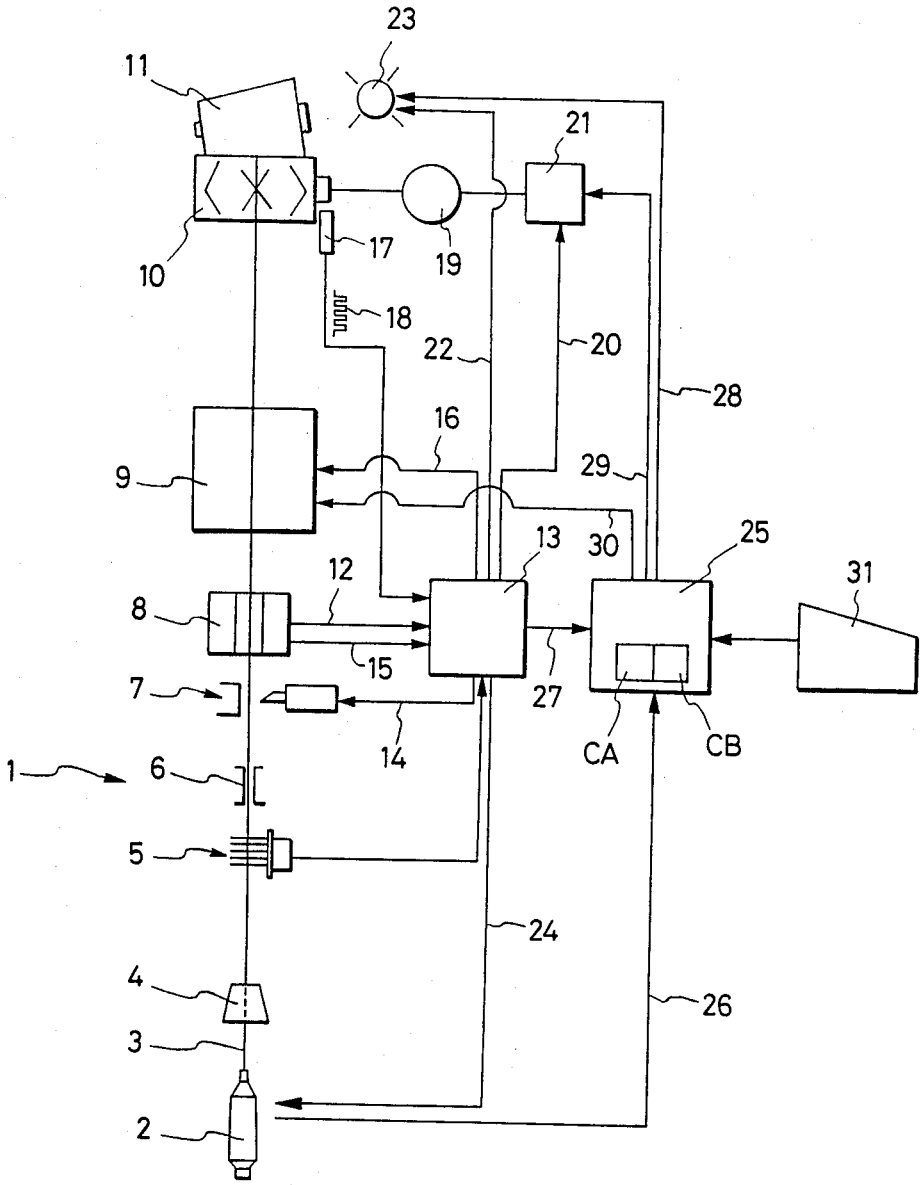
FIG. 1 is a schematic view of general construction showing an example of winding unit for embodying the method of the present invention, FIG. 2 a block diagram of detection of an upper limit value for the yarn cut frequency, FIG. 3 a time chart of the detection of FIG. 2, FIG. 4 a block diagram of detection of a lower limit value for the yarn cut frequency, FIG. 5 a time chart of the detection of FIG. 4, and FIG. 6 a chart illustrating a judging procedure of an unusual portion.

Referring to FIG. 1, there is shown an example of winding unit 1. Yarn 3 drawn out from a spinning bobbin (hereinafter referred to as bobbin 2) supplied to a fixed position passes a balloon breaker 4, a yarn feeler 5, a tension device 6 and a yarn defect detecting device of the photoelectric type or the electric capacitance type such as a slub catcher 8 and is wound, while being traversed, onto a package 11 which is driven by a traverse drum (hereinafter referred to as drum 10). During traveling of the yarn 3, if an increased thickness portion, a reduced thickness portion, a slub or the like is detected by the slub catcher 8, a slub signal 12 is delivered to a control unit 13, and a yarn cutting instructing signal 14 is delivered from the unit 13 so that a cutter device 7 is actuated to perform compulsory yarn cutting. In response to such yarn cutting, the yarn traveling signal 15 from a yarn traveling detector built in the slub catcher 8 is turned off, and immediately a yarn joining instructing signal 16 is delivered to a yarn joining device 9 on which known yarn joining operation is subsequently carried out. Such yarn joining operation is performed after a segment of yarn on the package 11 side is introduced to a predetermined position of the yarn joining device 9 by pivotal motion of a suction mouth not shown which attracts thereto and grasps thereon an end of the yarn on the package 11 side and another segment of yarn on the bobbin 2 side is introduced to the predetermined position of the yarn joining device 9 by pivotal motion of a suction pipe not shown which attracts thereto and grasps thereon an end of the yarn on the bobbin side. Accordingly, since the slub catcher 8 is located on the upstream side of the cutter device 7 in the arrangement of the embodiment, a yarn defect such as a slub remains at an end portion of the yarn on the package side at a stage before yarn joining is effected, and the yarn defect is removed by operation of the suction mouth and operation of the cutter in the yarn joining device. Accordingly, yarn joining is effected with ordinary portions of yarn.

Further, referring to FIG. 1, a pulse signal 18 is delivered to the control unit 13 during rotation of the drum 10 for which a contactless sensor 17 for detecting rotation of the drum 10 is provided, and a fixed length mechanism is constituted from a logical AND between the yarn traveling signal 15 and the pulse signal 18. Accordingly, although no pulse signal is developed during yarn joining operation after yarn cutting, if a pulse signal is developed, for a short period of time such pulses will not be counted if there exists no yarn traveling signal. In other words, no fixed length pulse is developed. Further, as the yarn traveling signal is turned off by such yarn cutting as described above, a stopping instructing signal 20 for a drive motor 19 for the drum 10 is developed from the unit 13 so that the motor 19 is stopped via an inverter 21 to stop winding operation. Further, when the package 11 is fully wound up by the fixed length mechanism, a full wind indicating lamp 23 is lit in response to a full wind signal 22.

In the meantime, when the layer of yarn on the bobbin 2 is used up during winding, the yarn feeler 5 detects absence of yarn so that the control unit 13 delivers a bobbin changing signal 24. Accordingly, the emptied bobbin is discharged from the winding unit and a new bobbin in a stand-by condition is supplied whereafter automatic yarn joining operation is performed and then winding of yarn is resumed. Further, also in the case of intermediate break of yarn such as yarn break by a slub or by tension which is caused during winding, if yarn joining is successfully conducted by such a yarn joining operation as described above, winding is begun again, but on the contrary if such yarn joining fails, a yarn joining operation is performed again. Thus, in case a preset number of yarn joining operations have failed, no more yarn joining operation is conducted because there is some cause of failure in drawing out of an end of yarn either on the package side or on the bobbin side. Instead, such control is effected that an alarm signal is delivered and operation of the unit is stopped, and then after readjustment by an operator, a start button is depressed to resume a yarn splicing operation.

Further, referring to FIG. 1, a control device 25 for effecting detecting an unusual condition of the slub catcher 8 is provided. In particular, the device 25 has two counters CA and CB built therein, and one CA of the counters detects an upper limit value m for the yarn cut frequency while the other counter CB detects a lower limit value n for the yarn cut frequency.

The upper limit value m for the yarn cut frequency is defined as follows. In particular, the upper limit value m for the yarn cut frequency represents an upper limit value for the yarn cut frequency per unit amount of yarn, and in practice, the amount of yarn for one bobbin is conveniently used as the unit amount of yarn. Accordingly, in the present embodiment, the value for the yarn cut frequency is set as a value for the yarn cut frequency within a time from a bobbin changing signal to a next bobbin changing signal. Further, the upper limit value m is set to a optimum value for practical use from various conditions such as a type and a count of the yarn, a grade of the package or a rate of operation of the winder. Accordingly, the value m is an arbitrarily changeable value. It is to be noted that, in addition to the amount of yarn for one bobbin, it is naturally possible to employ, as the unit amount of yarn, a unit length of yarn which has traveled if a fixed length function is made use of. Or otherwise, a unit time during which yarn is to travel or a unit traverse number can also be used.

Accordingly, each time yarn cutting occurs during winding, "+1" is added to the counter CA, and when a bobbin changing signal 26 is received, the counter CA is reset to zero. It is to be noted that while the slub detection signal 12, the signal 15 representing presence or absence of traveling of yarn, or the operating signal 14 for a solenoid for operating the cutter 7 can be applied as such a yarn cutting signal 27, it is necessary to confirm that the yarn break is an intermediate yarn break and to cause counting of one pulse for one yarn cutting without fail.

Meanwhile, the other counter CB detects the lower limit value n for the yarn cut frequency. The lower limit value for the yarn cut frequency is defined as follows. In particular, the lower limit value for the yarn cut frequency is represented either by a length of yarn or by a period of time for which the condition of no yarn cutting continues. Bobbins for which no yarn cutting occurs can exist by a ratio of several tens percent on the experimental or statistical basis. However, the probability that up to, for example, ten bobbins for which no yarn cutting occurs appear successively is very low. Accordingly, the number of successive such bobbins which is to be considered unusual is set as the lower limit value n for the yarn cut frequency. Also an optimum value is selected for the set value n from similar conditions such as a type of yarn or a mechanical efficiency. For example, if the lower limit value for the yarn cut frequency is set to $n=0$, at a time when a fifth new bobbin is supplied after winding of four successive bobbins for which no yarn cutting have occurred, an alarm device is operated in order to inform of the unusual condition. Accordingly, each time a bobbin changing signal is developed, the counter CB is incremented by one, and in response to development of a yarn cutting signal, the count value is reset to zero.

When the preset value is reached at either one of the counters CA and CB, an alarm signal 28, a winding stopping signal 29 and a yarn joining stopping signal 30 ar developed from the counter, and the condition of the winding unit 1 when the preset value is reached at the counter CA or CB is maintained, and either an operator or an automatic judging mechanism will determine an unusual condition of the slub catcher 8, an unusual condition of the bobbin 2 or the like. It is to be noted that control in the present embodiment is such that a yarn joining operation is performed only when the preset value is reached at the counter CB, and winding is stopped in a condition wherein the yarn extends continuously between the package 11 and the bobbin 2. Reference numeral 31 denotes an operation panel for input of preset values.

Figure 2:
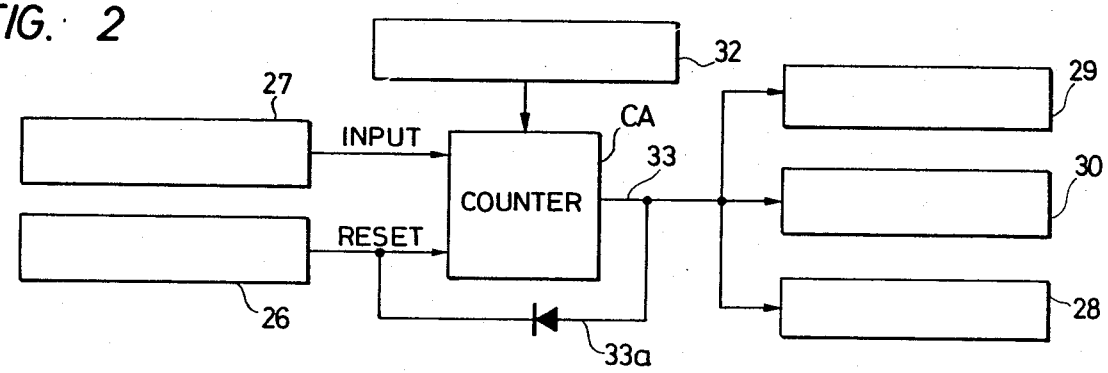
Figure 3:
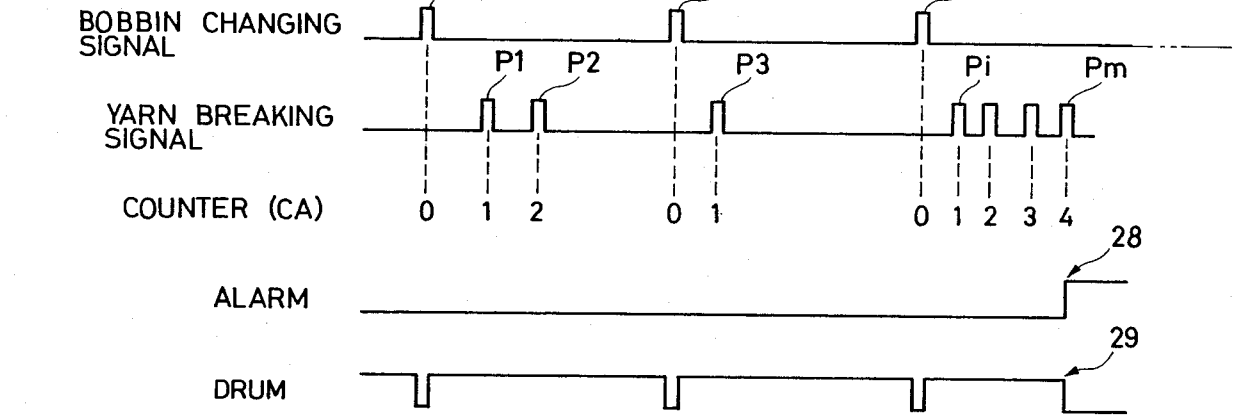

FIGS. 2 and 3 illustrate detection of the upper limit value for the yarn cut frequency. In particular, the aforementioned upper limit value m is preset 32 in the counter CA. The counter CA receives a yarn cutting signal 27 indicative of cutting of yarn, or more accurately, indicative of an intermediate break by a slub or by tension and increments and stores its count value, and when a bobbin changing signal 26 is received, the count value is reset to zero. When yarn cutting signals 27 are received by the preset number m by the counter CA, the counter CA stops its operation and develops an output signal in response to which stopping 29 of winding, stopping 30 of yarn joining and alarm indication 28 are effected. In the case of the present embodiment, referring to FIG. 1, the drum drive motor 19 is stopped by a winding stopping instruction 29 and the yarn joining device 9 is blocked by a yarn joining stopping instruction 30 while the full wind indicating lamp 23 is caused to flicker in response to an alarm indication instruction 28.

An example of time chart is shown in FIG. 3. In particular, in this instance, m=4 is set as the upper limit value for the yarn cut frequency, and each time a yarn cutting signal 27 P1 to Pi is received, the counter CA is incremented by one thereby and stores the incremented count value therein. Meanwhile, the counter CA is reset to zero by a bobbin changing signal Ql to Qi, and at a point of time Pm when the upper limit value m=4 is reached at the counter CA, the counter CA develops an alarm signal 28 to instruct of stopping 29 of the drum. Accordingly, in this instance, in a condition wherein the drum is stopped, yarn does not extend between the package 11 and the bobbin 2 and remains in a cut state. It is to be noted that the counter CA is reset also by an output signal 33*a* when the preset value is reached.

Figure 4:
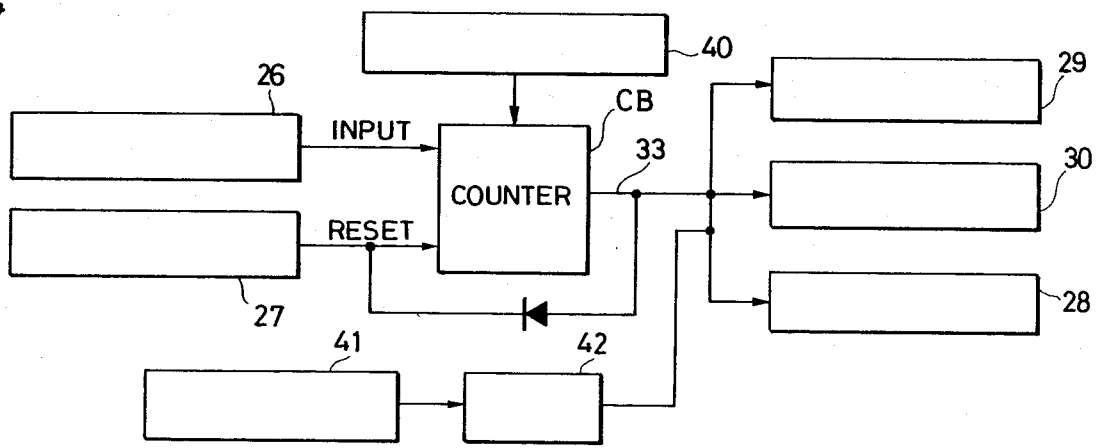
Figure 5:
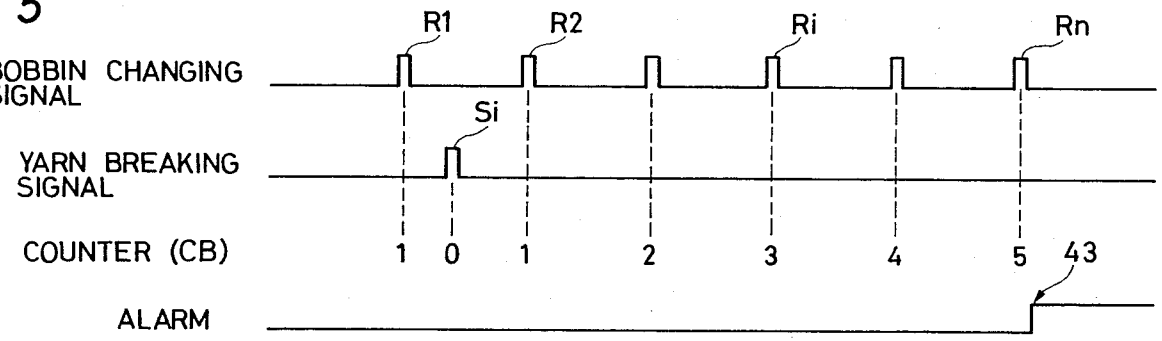

Subsequently, detection of the lower limit value n for the yarn cut frequency is illustrated in FIGS. 4 and 5. In particular, in this instance, where the lower limit value n for the yarn cut frequency is n=4, a value n+1, that is, "5" is inputted as a preset input 40 to the counter CB. Each time a bobbin changing signal Ri is developed, a signal 26 is received by the counter CB so that the counter CB is incremented by one thereby and stores the incremented count value therein. On the other hand, the counter CB is reset by a yarn cutting signal 27. When the count value reaches the preset value n+1, the counter CB stops its counting operation and delivers an output signal 33 to instruct of stopping 29 of winding, stopping 30 of yarn joining and alarm indication 28 under the condition that the yarn traveling signal FW is on 42 due to successful yarn joining 41. Accordingly, at the winding unit 1 which is stopped in response to detection of the lower limit value n, control is such that yarn 3 may extend continuously between the package 11 and the bobbin 2 of FIG. 1. For example, in the time chart of FIG. 5, the lower limit value n for the yarn cut frequency is preset to "4" and the preset input "5" is inputted to the counter CB, and each time a bobbin changing signal Ri is developed, the counter CB is incremented by one. On the other hand, the counter CB is reset to zero by a yarn cutting signal Si. When a bobbin changing signal is added so that the preset value "5" is reached, that is, when four bobbins for which no yarn cutting has occurred appear successively, the counter CB stops its counting operation and develops an output signal to turn the alarm on 43. In particular, when bobbin changing Rn for the fifth time is completed and then yarn joining is completed successfully, the alarm is operated so that the winding unit is stopped with the yarn thereon left extending in a continuous state.

When the preset value is reached at either one of the counters CA and CB, that is, when an unusual condition of yarn cutting is detected, the winding unit stops its winding operation, and the alarm lamp 23 is caused to flicker to inform an operator of it. The operator will find out the winding unit and determine an unusual condition based on a check list of FIG. 6.

In particular, when yarn does not extend between the package 11 and the bobbin 2 and the lamp 23 is flickering as seen in I), it is determined that there are unusually many yarn cuttings. In this instance, presence or absence of a yarn defect at an end portion of yarn on the package 11 side is checked in order to determine whether the bobbin is in an unusual condition or the slub catcher is in an unusual condition. When there is a defect at a portion of yarn near the end on the package side, it means that the function of the slub catcher operates to cut the yarn, and accordingly the slub catcher is operating regularly. Accordingly, in this instance, it is determined I-A that there is an unusual condition in the yarn of the bobbin. On the other hand, when there is no defect in yarn at the end portion on the package side, it is regarded that there is an unusual condition I-B in the slub catcher, and accordingly setting of the sensitivity or check or repair of the slub catcher is effected.

Figure 6:
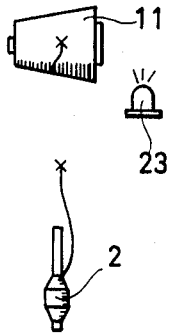
Figure 6:
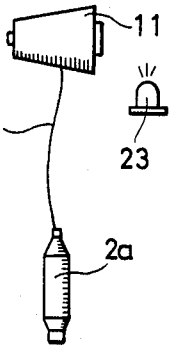

To the contrary, when the lamp 23 is flickering while the yarn 3 extends between the package 11 and the bobbin 2*a* as seen in II) of FIG. 6, it is determined that there is unusually little yarn cuttings, and an unusual condition II-A of the slub catcher is determined and check of the slub catcher is effected. It is to be noted that, in the case of II), since the winding unit is stopped just after completion of changing of a bobbin, normally the bobbin may not always have yarn fully wound thereon where the winder is of the type which has a bobbin supply system which can re-supply a bobbin with remaining yarn (a half wound bobbin) which is a fully wound bobbin. Nevertheless, where yarn extends in a continuous condition, it is determined that yarn cuttings are unusually little.

As apparent from the foregoing description, according to the present invention, discovery of a disabled slub catcher at an early stage is enabled, and the production of unacceptable goods can be prevented and accordingly the quality of yarn can be guaranteed. Thus, the problems of the conventional devices can be resolved.

What is claimed is:

1. A winding controlling method for an automatic winder, said method comprising the steps of:

setting an upper limit value for the yarn cut frequency which is defined as a yarn cut frequency per unit amount of yarn during winding, setting a lower limit value for the yarn cut frequency which is defined by an amount of yarn for which the condition continues wherein no yarn cutting occurs, detecting the yarn cut frequency occurring during winding and stopping winding of a winding unit at a point of time when either the upper limit value for the yarn cut frequency or the lower limit value for the yarn cut frequency is detected on said winding unit during winding.

2. A winding controlling method as claimed in claim 1, further comprising the step of providing a bobbin changing signal upon each occurrence of a bobbin changing condition of the winder wherein said unit amount of yarn comprises an amount of yarn wound about one bobbin and said step of setting an upper limit value for the yarn cut frequency comprises the step of setting a value for the yarn cut frequency which occurs within a time from a bobbin changing signal to a next bobbin changing signal.

3. A winding controlling method as claimed in claim 1, wherein said step of setting a lower limit value for the yarn cut frequency comprises the step of setting a value substantially equal to a predetermined number of successive bobbins for which no yarn cutting occurs.

4. A winding controlling method as claimed in claim 1, wherein said steps of setting, detecting and stopping are performed by using a control device having a first counter means for detecting the upper limit value for the yarn cut frequency and a second counter means for detecting a lower limit value for the yarn cut frequency.

5. A winding controlling method as claimed in claim 4, further comprising the steps of providing a bobbin changing signal upon each occurrence of a bobbin changing condition of the winder, and providing a yarn cutting signal upon occurrence of a yarn cutting condition of the winder, wherein said step comprises the step of counting with said first counter the yarn cut frequency which occurs within a time from a bobbin changing signal to a next bobbin changing signal, incrementing said second counter by one each time a bobbin changing signal is developed, and resetting the second counter to zero in response to a yarn cutting signal.

6. A winding controlling device for controlling the winding operation of an automatic winder, wherein said winding operation includes an operation of cutting yarn, said device comprising:

first preset means for setting an upper limit value for the frequency at which the yarn cutting operation is performed per unit amount of yarn;

second preset means for setting a lower limit value for the frequency at which the yarn cutting operation is performed, said lower limit value being determined by an amount of yarn for which the condition continues wherein no yarn cutting occurs;

a first counter for counting the yarn cut frequency during winding;

a second counter for counting the amount of yarn wound during the condition wherein no yarn cutting occurs; and stopping means for stopping a winding operation in response to receipt of the preset value by either one of the first and second counters.

7. A method of controlling the yarn winding operation of the automatic winder, said method comprising the steps of:

detecting the frequency at which the yarn is severed during the winding operation;

comparing the frequency at which the yarn is severed with an upper threshold value;

comparing the frequency at which the yarn is severed with a lower threshold value; and providing a control signal upon the frequency at which the yarn is severed reaching at least one of the upper and lower threshold value.

8. A method as claimed in claim 7, further comprising the step of:

presetting the upper threshold value; and presetting the lower threshold value.

9. A method as claimed in claim 7, further comprising the steps of:

detecting yarn defects during the winding operation; and operating a yarn cutter in response to a defect detected during the winding operation;

wherein said step of detecting the frequency at which the yarn is severed comprises the step of detecting the frequency of the operation of the yarn cutter.

10. A method as claimed in claim 9, wherein the automatic winder includes a bobbin changing means for changing the bobbin on which the automatic winder operates, said method further comprising the step of:

providing a bobbin changing signal in association with the changing of the bobbin on which the automatic winder operates, wherein said step of comparing the detected frequency at which the yarn is severed with a preset lower threshold value comprises the steps of:

counting the number of bobbin changing signals provided during the winding operation;

resetting the count of bobbin changing signals to zero upon operating the yarn cutter; and comparing the count of bobbin changing signals with the preset lower threshold value.

11. A method as claimed in claim 9, wherein the automatic winder includes a bobbin changing means for changing the bobbin on which the automatic winder operates, said method further comprising the step of:

providing a bobbin changing signal in association with the changing of the bobbin on which the automatic winder operates, wherein said step of comparing the detected frequency at which the yarn is severed with a preset upper threshold value comprises the steps of:

counting the number of operations of the yarn cutter;

resetting the count of operations of the yarn cutter to zero upon providing the bobbin changing signal; and comparing the count of operations of the yarn cutter with the preset upper threshold value.

12. A method as claimed in claim 10, wherein said step of comparing the detected frequency at which the yarn is severed with a preset upper threshold value comprises the steps of:

counting the number of operations of the yarn cutter;

resetting the count of operations of the yarn cutter to zero upon providing the bobbin changing signal; and comparing the count of operations of the yarn cutter with the preset upper threshold value.

13. A method as claimed in claim 11, wherein the automatic winder includes a drive means operable for driving yarn during the winding operation, yarn joining means operable for joining severed yarn, and an alarm indicator, said method further comprising at least one of the following steps:

stopping the operation of the drive means upon providing the control signal;

stopping the operation of the yarn joining means upon providing the control signal; and actuating the alarm indicator upon providing the control signal.

14. A method as claimed in claim 12, wherein the automatic winder includes a drive means operable for driving yarn during the winding operation, yarn joining means operable for joining severed yarn, and an alarm indicator, said method further comprising at least one of the following steps:

stopping the operation of the drive means upon providing the control signal;

stopping the operation of the yarn joining means upon providing the control signal; and actuating the alarm indicator upon providing the control signal.

15. A control device for controlling the yarn winding operation of an automatic winder on a yarn bobbin, the automatic winder having a yarn cutting device operable for cutting yarn drawn out from the bobbin during the yarn winding operation, said control device comprising:

first detecting means for detecting the frequency at which the yarn is severed by the yarn cutting device;

first comparing means, having a first preset value, for comparing the detected frequency with said preset value;

second comparing means, having a second preset value, for comparing the detected frequency with said second preset value; and signal providing means for providing a control signal upon the detected frequency reaching at least one of the first or second preset values.

16. A control device as claimed in claim 15, wherein said first preset value comprises an upper threshold values for the detected frequency and said second preset value comprises a lower threshold value for the detectet frequency.

17. A control device as claimed in claim 16, further comprising presetting means for presetting said first and second threshold values.

18. A control device as claimed in claim 15, wherein the automatic winder further has bobbin changing means operable for changing the bobbin on which the automatic winder operates, said control device further comprises:

second detecting means for detecting the operation of the bobbin changing means;

wherein said first detecting means comprises a first counting means for counting the number of operation of the bobbin changing means detected by said second detecting means and first reset means, responsive to the operation of the yarn cutting device, for resetting the number counted by the first counting means to zero upon the operation of the yarn cutting device; and wherein said second comparing means includes means for comparing the number counted by the first counting means with the second preset value.

19. A control device as claimed in claim 15, wherein the automatic winder further has bobbin changing means operable for changing the bobbin on which the automatic winder operates, said control device further comprises:

second detecting means for detecting the operation of the bobbin changing means;

wherein said first detecting means comprises a second counting means for counting the number of operations of the yarn cutter and second reset means, responsive to the second detecting means, for resetting the number counted by the second counting means to zero upon the operation of the bobbin changing means; and wherein said first comparing means includes means for comparing the number counted by the second counting means with the first preset value.

20. A control device as claimed in claim 18, wherein:

said first detecting means comprises second counting means for counting the number of operation of the yarn cutter and second reset means, responsive to the second detecting means, for resetting the number counted by the second counting means to zero upon the operation of the bobbin changing means; and said first comparing means includes means for comparing the number counted by the second counting means with the first preset value.

* * * * *